US007752865B2

(12) United States Patent
Skinner

(10) Patent No.: US 7,752,865 B2
(45) Date of Patent: Jul. 13, 2010

(54) ICE CUBE CATCHER

(76) Inventor: Charles J. Skinner, 905 Tartan Trail, Bloomfield Hills, MI (US) 48304

( * ) Notice: Subject to any disclaimer, the term of this patent is extended or adjusted under 35 U.S.C. 154(b) by 24 days.

(21) Appl. No.: 12/099,573

(22) Filed: Apr. 8, 2008

(65) Prior Publication Data

US 2009/0249819 A1 Oct. 8, 2009

(51) Int. Cl.
*F25B 17/00* (2006.01)
*F25C 5/18* (2006.01)

(52) U.S. Cl. ..... 62/344; 62/377; 222/146.6

(58) Field of Classification Search ..... 62/340–356, 62/377, 441; 222/146.6; 312/401, 405.1
See application file for complete search history.

(56) References Cited

U.S. PATENT DOCUMENTS

| | | | | |
|---|---|---|---|---|
| 3,216,213 | A | | 11/1965 | Eschenburg et al. |
| 3,226,939 | A | | 1/1966 | Harbison et al. |
| 3,537,132 | A | | 11/1970 | Alvarez |
| 3,744,270 | A | | 7/1973 | Wilcox |
| 3,877,767 | A | | 4/1975 | Bright |
| 3,883,204 | A | | 5/1975 | Prada et al. |
| 3,998,069 | A | | 12/1976 | Kronenberger et al. |
| 4,087,140 | A | | 5/1978 | Linstromberg |
| 4,680,943 | A | * | 7/1987 | Mawby et al. ..... 62/300 |
| 5,033,273 | A | | 7/1991 | Buchser et al. |
| 5,273,354 | A | | 12/1993 | Herrmann et al. |
| 5,474,213 | A | | 12/1995 | Unger |
| 5,516,204 | A | | 5/1996 | Calvert et al. |
| 5,806,333 | A | | 9/1998 | Kim et al. |
| 5,886,430 | A | | 3/1999 | Ralson et al. |
| 6,050,097 | A | | 4/2000 | Nelson et al. |
| 6,082,130 | A | | 7/2000 | Pastryk et al. |
| 6,148,624 | A | | 11/2000 | Bishop et al. |
| 6,595,021 | B2 | | 7/2003 | Skinner |
| 7,013,667 | B2 | | 3/2006 | Jung |

OTHER PUBLICATIONS

Eflecto Corporation Technical Product Specifications, Economy Air Deflector Model 101 (2001).
Deflecto Corporation Technical Product Specifications, Unbreakable Air Deflector Model 50 (2001).

* cited by examiner

*Primary Examiner*—William E Tapolcai
(74) *Attorney, Agent, or Firm*—Gifford, Krass, Sprinkle, Anderson & Citkowski, P.C.

(57) ABSTRACT

An ice cube catcher is disclosed for positioning on a door of a refrigerator to catch ice cubes dispensed from an in-door dispenser. The catcher may include a body having a sloped portion and a pair of sidewalls. The sloped portion may include a top and a bottom edge and a pair of ends. The sidewalls may be positioned at each end of the sloped portion and include a flange portion. These flange portions may have a fastener that may operable to secure the body to a refrigerator door. Finally, a water retention portion such as ridge or dam or groove be provided proximate the bottom edge of the sloped portion to retain water from melting ice within the body of the catcher.

15 Claims, 3 Drawing Sheets

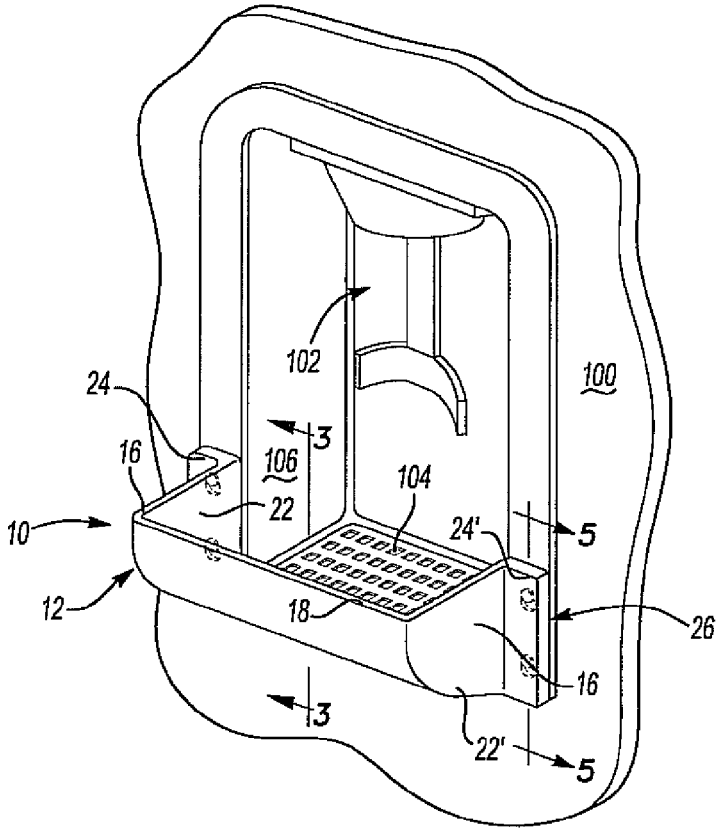
Fig-1
Fig-2
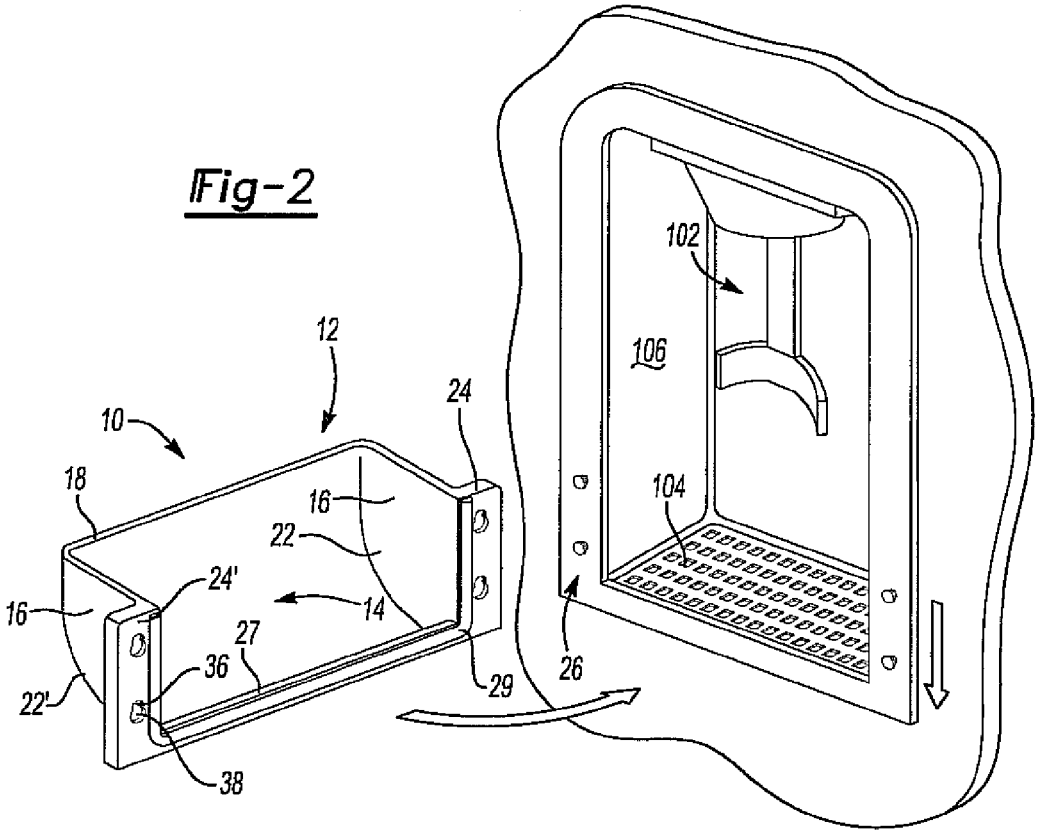

ICE CUBE CATCHER

FIELD OF THE INVENTION

Disclosed herein are embodiments for an ice cubes catching apparatus. More particularly, disclosed herein are embodiments for a device that may be positioned on, or near, or molded integral to, a refrigerator in-door ice cube dispenser to catch ice cubes ejected from the dispenser. The catcher may be equipped with a water retention portion such as a dam or groove that may retain the water from melting ice cubes caught by the device and thereby inhibit water from draining onto the floor.

BACKGROUND OF THE INVENTION

A refrigerator with an in-door ice cube dispenser will often include a small shelf on which to place a glass. The shelf also functions to catch ice cubes that are ejected from the dispenser, but not caught in a user's glass. Such shelves, however, do not include a front barrier. Therefore, they are ineffective at preventing the ejected ice cubes from falling to the floor.

Applicant's U.S. Pat. No. 6,595,021 disclosed an ice cube catcher that may be attached to a refrigerator door proximate a dispenser to catch and retain the ice cubes. It has been found, however, that melting ice cubes left in the catcher may result in water draining between the catcher and the refrigerator door and onto the floor. Therefore, it would be beneficial to provide for an improved ice cube catcher that can mitigate the opportunity for ice melt to reach the floor.

SUMMARY OF THE INVENTION

The ice cube catcher disclosed herein may include a body having a sloped portion and a pair of sidewalls. The sloped portion of the body may have a top edge and a bottom edge and a pair of ends. The sidewalls of the body may each be positioned at one end of the sloped portion, with each sidewall also optionally including a flange portion. The catcher may also include a lower flange that extends downwardly from the bottom edge.

A fastener may be used to secure the catcher to a refrigerator door proximate an in-door ice cube dispenser. This fastener may be positioned on, defined in, or made integral with the body. For example, the fastener may be provided on one or all of the flanges.

A water retention portion including ridge, dam, groove or trough may also be provided to retain the water from melting ice within the catcher and thereby inhibit the water from draining onto the floor. The dam, for example, may extend upwardly, substantially vertically from the bottom edge of the sloped portion of the body of the catcher.

BRIEF DESCRIPTION OF THE DRAWINGS

Reference will now be made to the accompanying drawings, wherein like reference numerals refer to like parts throughout, and which will provide the reader with a clearer understanding of the present invention.

FIG. 1, is a perspective view of an embodiment for an ice cube catcher showing the catcher positioned on a refrigerator door proximate an ice cube dispenser;

FIG. 2, is another perspective view of the embodiment of FIG. 1 for an ice cube catcher showing the catcher separated from a refrigerator door;

DETAILED DESCRIPTION OF THE PREFERRED EMBODIMENTS

Figure 3:
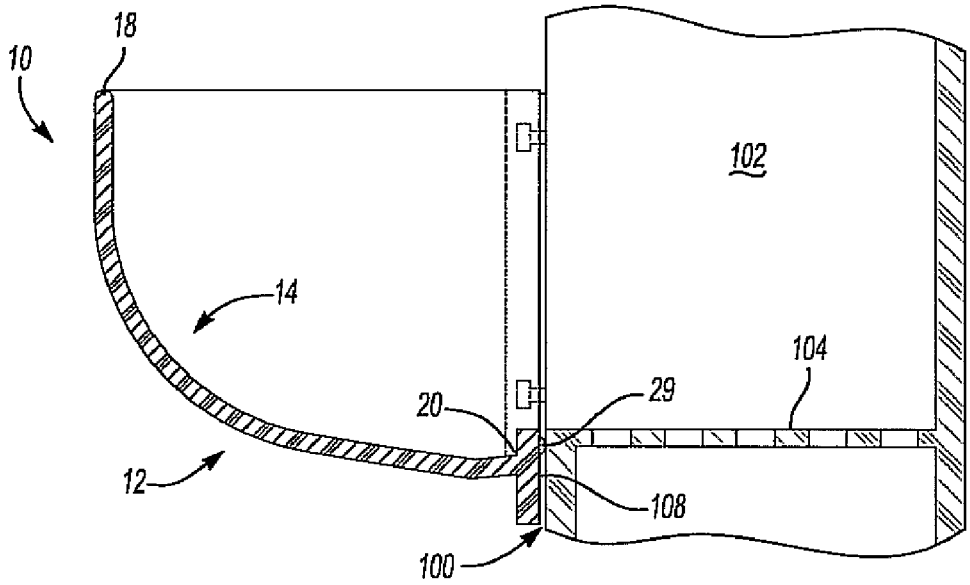
FIG. 3 is a planar side cut-away view of the embodiment of FIG. 1 for an ice cube catcher.

Referring now to FIGS. 1, 2, 3 and 7, there is shown an embodiment of an ice cube catcher 10. The ice cube catcher 10 may include a body 12 having a sloped portion 14 and a pair of sidewalls 16. The sloped portion 14 may have a top 18 edge, a bottom edge 20 and a pair of ends 22, 22'. The sidewalls 16 may each be positioned at an end 22, 22' of the sloped portion 14 and include a flange portion 24, 24'. It will also be appreciated that the catcher 10 may dispense with the use of flange 24, 24' and/or simply rely upon the lower flange portion 31 as the exclusive means of positioning the catcher 10 to the refrigerator.

A fastener 26, that may operate to secure the body 12 of the catcher 10 to a refrigerator door 100 (proximate an in-door ice cube dispenser 102), may be positioned on, defined in, or made integral with each flange 24, 24' and/or the lower flange 31.

A water retention portion may also be provided to function as a reservoir that collects water from melting ice (not shown) in the catcher 10. The water retention portion may include a ridge or darn 27 that may extend upwardly, substantially vertically from the bottom edge 20 of the sloped portion 14 of the body 12 of the catcher 10. In additional, as will be described further below (see FIG. 8), the water retention portion may also include a groove or trough defined in, or formed by, the sloped portion 14 proximate the bottom edge 20. Water that may pass over or through the water retention portion may also be prevented from flowing through a seam 108 between the refrigerator door 100 and ice cube catcher 10 by a gasket 29 (or seal) that may be positioned along the side flange portions 24, 24' and/or the lower flange portion 31.

Still referring to FIGS. 1, 2, 3 and 7, the catcher 10 may be constructed as a one-piece device from PVC or the like. For example, the catcher 10 may be molded using known plastic techniques and materials. However, materials such as glass, plexiglass, fiberglass, aluminum and stainless steel may also be used in the construction of all or a portion of the catcher 10.

Still referring to FIGS. 1, 2, 3 and 7, the sloped portion 14 of the catcher 10 may function to catch or deflect ice cubes (not shown) that may be ejected from the dispenser 102, and then guide the cubes back toward and/or into the shelf 104 of the dispenser 102. Therefore, as shown in FIG. 3, the sloped portion 14 may be formed to have a substantially constantly curved radius (such that the slope portion 14 forms, for example, an arc of about 90 degrees). The arc may also, for example, be constructed for form an arc of between 25 and 85 degrees. It will, however, be appreciated that the radius of the sloped portion 14 need not be constant. In addition, the sloped portion 14 may be more angular in design such that, instead of a curved surface, the sloped portion 14 includes a plane angled at between 25 and 75 degrees relative to horizontal, or at another angle sufficient to best meet the requirements of a particular refrigerator model and/or a particular ice cube dispenser 102. Further, it will also be appreciated that the specific shape of the sloped portion 14 is not limited to the specific embodiments disclosed above. As such, the sloped portion 14 may include a combination of angles and/or curved areas that function to guide ice back toward the dispenser 102 (and/or function as a reservoir for water).

Figure 4:
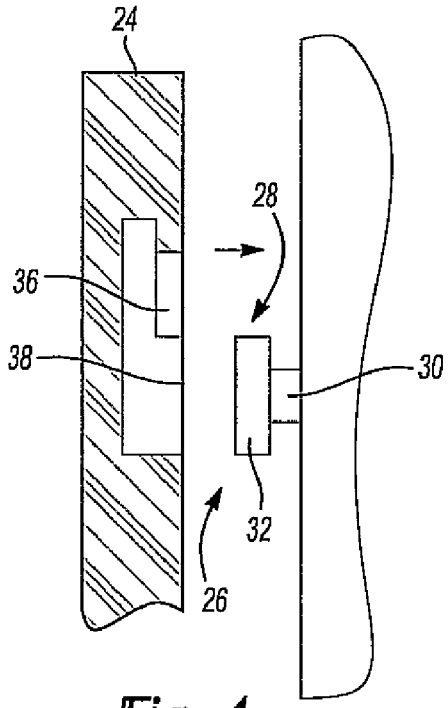
FIG. 4 is a planar side view of the embodiment of an ice cube catcher of FIG. 1 showing a fastener for the catcher separated from a fastener on the refrigerator door.
Figure 5:
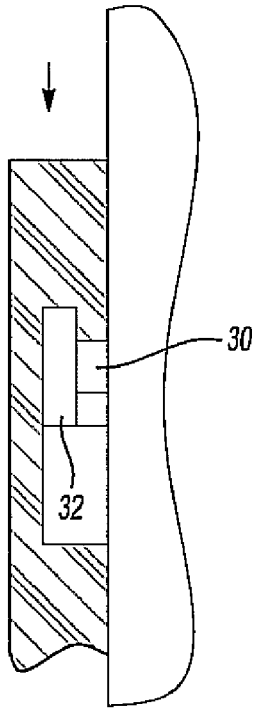
FIG. 5 is a planar side view of an embodiment of FIG. 1 for an ice cube catcher taken along line 5-5 of FIG. 1 showing a fastener for the catcher engaging a fastener on the refrigerator door.

Referring now to FIGS. 1-6, the fastener 26 used to position the catcher 10 on the refrigerator or dispenser 102 may come in a variety of forms. For example, as shown in FIGS. 4 and 5, the fastener 26 may include a post lock or bracketing arrangement. In such an arrangement, posts 28 having an interior diameter 30 and a larger exterior diameter 32 are provided on the dispenser 102. These posts 28 may be passed through and supported in apertures 34 that are defined in each flange 24, 24', apertures thus also including a first diameter 36 and a second larger diameter 38. More specifically, the posts 28 may first be aligned (as shown in FIG. 4) and then moved through the larger diameter 38 portion of the aperture 34. The catcher 10 may then be moved downwardly so that the interior diameter 30 portion of each post 28 removeably rests in the first diameter 36 portion of the apertures 34.

Figure 6:
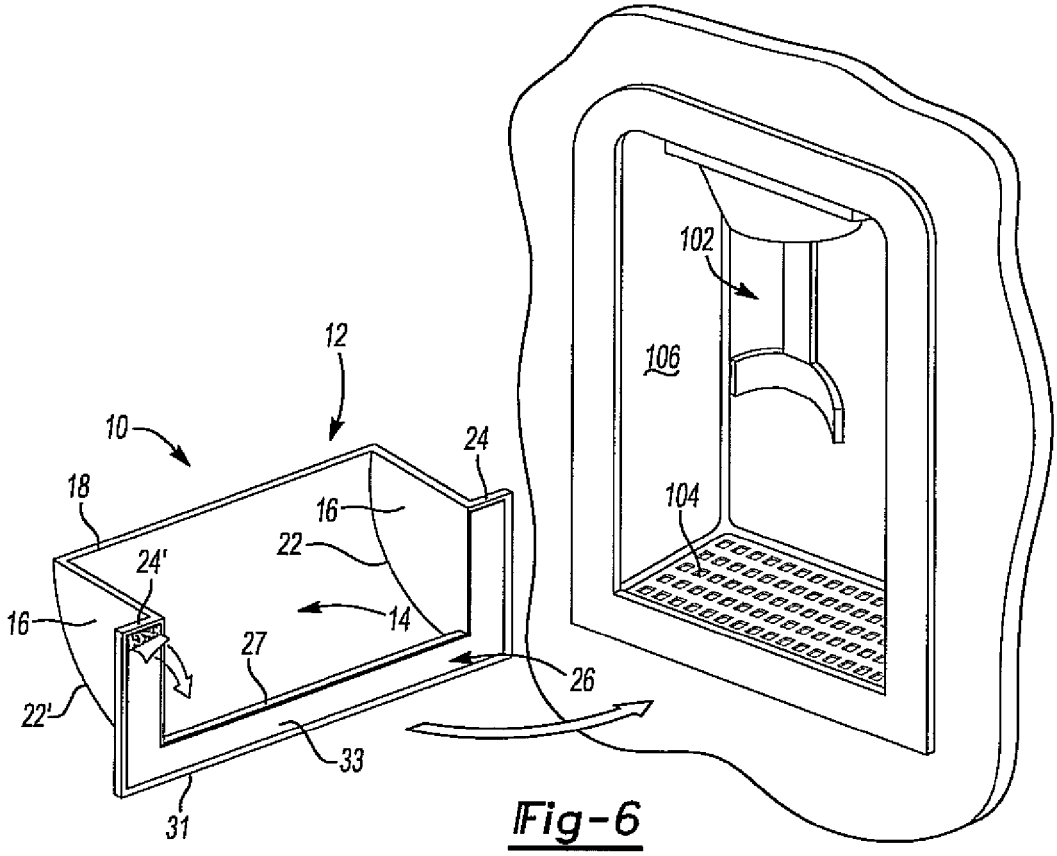
FIG. 6 is a perspective view of the embodiment of FIG. 1 for all ice cube catcher showing the catcher positioned on a refrigerator door proximate an ice cube dispenser and showing the use of two-side tape to secure the catcher to the door.
Figure 7:
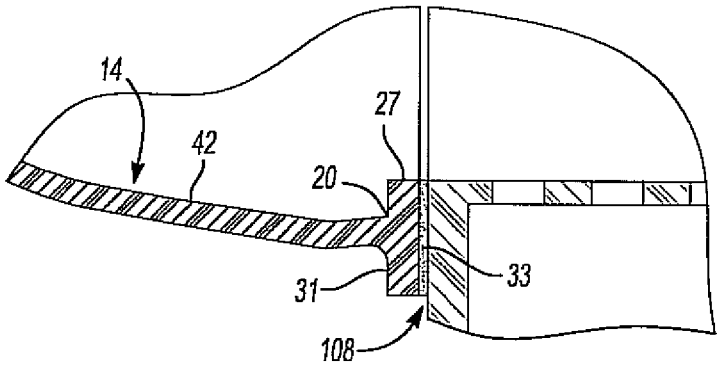
FIG. 7 is a planar side cut-away view of the embodiment for an ice cube catcher mounted to the refrigerator door using two-side tape.

However in addition to post lock or bracketing arrangement described above, the fastener 26 may include or consist of a magnet(s) and/or magnetic tape, a mounting tape and/or, a double-sided tape, or a hook and loop fastener (e.g., VELCO®). For example, as shown in FIGS. 6 and 7, double sided tape 33 may be applied to the flange portions 24, 24' and/or the lower flange 31 so that the catcher 10 may be secured to the refrigerator door 100. It will also be appreciated that when double side tape 33 is used the tape may function as the gasket 29.

In addition, the fastener 26 may comprise slots that are disposed on the refrigerator, the refrigerator door 100 and/or the dispenser 102 that may be slidably engaged by the flanges 24, 24'. The fastener 26 may also include screws, sealants, resins and the like that may function to temporarily or permanently secure the catcher to the refrigerator 100 and/or the dispenser 102 depending on the needs of the user.

Referring again to FIGS. 1, 2, 3 and 7; a water retention portion such as a ridge or dam 27 may extend upwardly, substantially vertically from the bottom edge 20 of the sloped portion 14. In one embodiment, the dam 27 may have a height of about three-sixteenths ($3/16^{th}$) of one inch and a width of three-eighths (3/8) of one inch. However, it will be appreciated that the height and width may be varied according to the needs of the user. As such, the height of the darn 27 may be within a range between one-sixteenth ($1/16^{th}$) to one and a half inches (1½), and the width may be within a range between one-sixteenth ($1/16^{th}$) to three-quarters (¾) of one inch.

Figure 8:
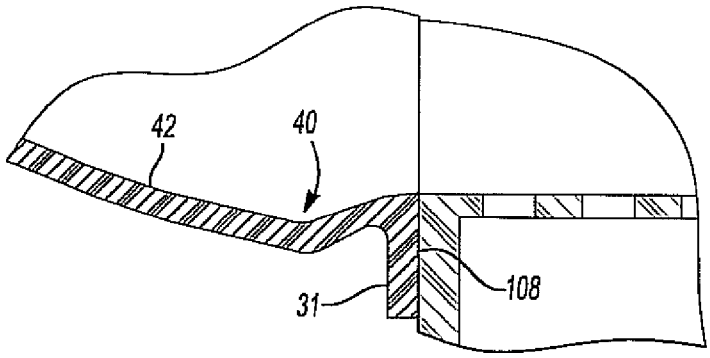
FIG. 8 is a planar side cut-away view of another embodiment for an ice cube catcher showing the use of a groove or trough for collecting melting water instead of a darn.

Furthermore, as best shown in FIG. 8, the water retention portion may also include a groove or trough 40 that may be defined in, or formed from, the interior surface 42 of the sloped portion 14. Like the dam 27, the trough 40 may function as a reservoir or water retention area that collects water from melting ice within the body 12 of the catcher 10. Specifically, the water may be inhibited from flowing between a seam 108 that may exist between the catcher 10 and the refrigerator door 100 or dispenser 102 and then onto the floor.

The depth of the trough 40 may defined in accordance with the needs of the user. However, it will be appreciated that the depth may be within a range between one-sixteenth ($1/16^{th}$) to one and a half inches (1½) from a horizontal plane extending from the bottom edge 20.

In operation, ice cubes (not shown) that are ejected from the dispenser 102 may be caught or otherwise deflected by the slope portion 14 of the catcher 10. Once caught (or deflected), the cubes may slide down the sloped portion 14 and either: pass back into the shelf 104 in the dispenser area 106; or 2) collect and begin melting proximate the bottom edge 20 of the catcher 10. When the ice cube begin melting proximate the bottom edge 20 of the catcher 10 the water retention portion functions to retain the water within the body 12 of the catcher 10. As such, the water is inhibited from flowing between the seam 108 that may exist between the catcher 10 and the refrigerator 100 or dispenser 102 and then onto the floor.

Having thus described my invention, it will be apparent to the skilled artisan that many modifications and changes can be made to the above embodiments without departing from the spirit of the invention.

I claim:

1. An ice cube catcher for attachment to a door of a refrigerator to catch ice cubes dispensed from an outlet of an ice cube dispenser mounted within said door, the catcher comprising:

a body having a sloped portion, a pair of sidewalls and a water retention portion, the sloped portion including a top edge, a bottom edge, a pair of ends and being shaped so that fluid will flow away from the top edge and toward the bottom edge, the water retention portion being positioned at one of the bottom edge or proximate the bottom edge to inhibit fluid flowing passed the bottom edge and being selected from one of a ridge, dam, groove and trough, and one of each of the pair of sidewalls being positioned at an end of the sloped portion, each sidewall having a flange portion, and each flange portion have a fastener operable to position the body on a refrigerator door.

2. The ice cube catcher of claim 1, wherein the sloped portion comprises an interior surface having a constantly curved radius.

3. The ice cube catcher of claim 2, wherein the interior surface of the sloped portion comprises an arc of about 90 degrees.

4. The ice cube catcher of claim 1, wherein the fastener comprises double sided tape.

5. The ice cube catcher of claim 1, wherein the body comprises a one-piece body.

6. An ice cube catcher for attachment to a door of a refrigerator proximate an in-door ice cube dispenser comprising:

a body having a sloped portion, a pair of sidewalls, a water retention portion, and a fastener, the fastener being operable to position the body on a refrigerator proximate an in-door ice cube dispenser, the sloped portion including a top edge, a bottom edge, a pair of ends and being shaped so that fluid will flow away from the top edge and toward the bottom edge, the water retention portion being positioned at one of the bottom edge or proximate the bottom edge to inhibit fluid flowing passed the bottom edge and being selected from one of a ridge, dam, groove and trough, and one of each of the pair of sidewalls being positioned at an end of the sloped portion, and the body also including a lower flange portion at the bottom edge of the sloped portion extending substantially vertically downward from the body.

7. The ice cube catcher of claim 6, wherein the sloped portion comprises an interior surface having a constantly curved radius.

8. The ice cube catcher of claim 7, wherein the interior surface of the sloped portion comprises an arc of about 90 degrees.

9. The ice cube catcher of claim 6, wherein the fastener comprises a post lock.

10. The ice cube catcher of claim 6, wherein the body comprises a one-piece body.

11. An ice cube catcher for attachment to a door of a refrigerator proximate an in-door ice cube dispenser comprising:

a body having a sloped portion, a pair of sidewalls, and a water retention portion selected from one of a ridge, dam. groove and trough, the sloped portion including a top edge, a bottom edge, a pair of ends and being shaped so that fluid will flow away from the top edge and toward the bottom edge, one of each of the pair of sidewalls being positioned at an end of the sloped portion, each sidewall having a flange portion, and the body also including a lower flange extending downwardly from the bottom edge, a gasket positioned on each flange, and a fastener operable to position the body on a refrigerator door proximate an in-door ice cube dispenser.

12. The ice cube catcher of claim 11, wherein the sloped portion comprises an interior surface have a constantly curved radius.

13. The ice cube catcher of claim 12, wherein the interior surface of the sloped portion comprises an arc of about 90 degrees.

14. The ice cube catcher of claim 11, wherein the water retention portion comprises a trough defined in the sloped portion proximate the bottom edge, the trough having a predetermined depth below a horizontal plane extending from the bottom edge.

15. The ice cube catch of claim 11, wherein the fastener comprises one of a post lock, magnetic tape, a double-sided tape, a hook and loop fastener or refrigerator slots.

* * * * *